US007274889B2

(12) United States Patent
Furukawa

(10) Patent No.: US 7,274,889 B2
(45) Date of Patent: Sep. 25, 2007

(54) IMAGE FORMING APPARATUS WITH DEVELOPER-CLEANING CAPABILITIES

(75) Inventor: Toshio Furukawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 206 days.

(21) Appl. No.: 10/957,646

(22) Filed: Oct. 5, 2004

(65) Prior Publication Data

US 2005/0074265 A1 Apr. 7, 2005

(30) Foreign Application Priority Data

Oct. 7, 2003 (JP) ..... 2003-348271

(51) Int. Cl.
*G03G 15/00* (2006.01)

(52) U.S. Cl. ..... 399/71; 399/101

(58) Field of Classification Search ..... 399/71, 399/100, 101, 129, 149, 228, 235, 264, 344, 399/353, 354, 357
See application file for complete search history.

(56) References Cited

U.S. PATENT DOCUMENTS 5,740,493 A * 4/1998 Otaki et al. ..... 399/71
5,832,336 A * 11/1998 Kawasaki et al. ..... 399/71
5,943,533 A * 8/1999 Ogata et al. ..... 399/168
5,966,563 A * 10/1999 Kashihara et al. ..... 399/100
6,029,033 A * 2/2000 Kawasaki ..... 399/149
6,081,679 A * 6/2000 Yamane et al. ..... 399/71
6,650,850 B2 * 11/2003 Nishimura ..... 399/50
6,810,223 B2 * 10/2004 Eun et al. ..... 399/150

* cited by examiner

*Primary Examiner*—Robert Beatty
(74) *Attorney, Agent, or Firm*—Oliff & Berridge, PLC

(57) ABSTRACT

An image forming apparatus comprises: a photosensitive element; a charger electrostatically charging a surface of the photosensitive element uniformly at a voltage of a polarity; an exposure device exposing the charged surface of the photosensitive element, to a light, to form an electrostatic latent image; a developing device depositing a developer on the latent image, to form a developer image; a device for transferring the developer image onto a transfer object; and a developer removing device comprising a cleaning member, to which a voltage is applied to generate a cleaning bias between the cleaning member and photosensitive element, to remove a waste developer adhering to the photosensitive element after the developer image is transferred, and which is disposed to act on a part of the surface of the photosensitive element having been charged by the charger and at which the developer image is not formed yet.

15 Claims, 6 Drawing Sheets

IMAGE FORMING APPARATUS WITH DEVELOPER-CLEANING CAPABILITIES

The present application is based on Japanese Patent Application No. 2003 348271 filed on Oct. 7, 2003, the content of which is incorporated herein by reference.

BACKGROUND OF THE INVENTION

1. Field of the Invention

The present invention relates to an image forming apparatus for forming an image on a transfer object, by forming a visible image on a surface of a photosensitive element with electrically charged toner particles, and electrostatically transferring the visible image onto the transfer object.

2. Discussion of Related Art

As a kind of an image forming apparatus for forming an image on a transfer object such as a sheet of paper, there is known an apparatus having a photosensitive element, a charger for uniformly charging a surface of the photosensitive element at a voltage of a polarity, an exposure device for exposing the electrically charged surface of the photosensitive element to a light, so as to form an electrostatic latent image thereon, a developing device for forming a visible image (i.e. developer image) by depositing toner particles (i.e. developer) of a color on the electrostatic latent image formed by the exposure device, and a transferring device for transferring the developer image formed on the surface of the photosensitive element onto the transfer object.

There is known a problem encountered when the transferring device of such a kind of an image forming apparatus transfers the toner particles forming the developer image, onto the transfer object. Namely, some toner particles are electrostatically charged in a polarity reverse to a regular polarity in which the toner particles are charged to be attracted to the photosensitive element to form the visible or toner image corresponding to the latent image, and a part of such toner particles charged in the reverse polarity fails to be transferred onto the transfer object and is left as a waste toner on the photosensitive element after the transferring step.

The polarity of the charge of the waste toner on the photosensitive element is again reversed to the regular polarity, when the charger charges the surface of the photosensitive element for forming the next visible image (i.e., toner image) on the surface of the photosensitive element, and then the waste toner is transferred onto a transfer object by the transferring device. The waste toner reversely charged, that is, the waste toner charged in the polarity reverse to the regular polarity in which the toner particles are charged to form the visible toner image on the photosensitive element, is often left at locations on the photosensitive element where the next visible image is not to be formed, adversely affecting the next visible image.

In a case where the image forming apparatus is for color printing and constructed to sequentially form a plurality of toner images on the photosensitive element by using respective color toners, it may occur that a part of reversely charged particles of a toner of a first color is carried by and on the transfer object to a position to be brought into contact with a photosensitive element for forming a toner image of a second color, and thus retransferred to the photosensitive element for the second color.

The reversely charged toner particles retransferred onto the photosensitive element for the second color may adhere to, and intrude into, a developing device for the second color, which makes the second color mixed with the first color inside the developing device for the second color. In this case, the color of the toner image formed by the developing device for the second color is made different from the expected one.

To solve these problems, there has been proposed in JP-A-2000-242152 an image forming apparatus equipped with a cleaning member or roller, which is disposed to be opposed to a photosensitive element and removes a waste toner as reversely charged from a surface of the photosensitive element, by electrostatically attracting the waste toner.

Meanwhile, the waste toner adhering to the surface of the photosensitive element is not constituted solely by reversely charged toner particles, but regularly charged toner particles, i.e., toner particles charged in the regular polarity, are also included in the waste toner. The regularly charged waste toner particles have failed to be transferred to the transfer object, and remain on the photosensitive element even after the toner image is transferred onto the transfer object.

Having the same polarity as the cleaning roller, the regularly charged waste toner particles are not attracted to the cleaning roller, and thus can not be removed in the conventional apparatus.

To remove such regularly charged waste toner, there may be additionally provided another cleaning roller which is charged in a polarity suitable for attracting the regularly charged waste toner. In this case, however, the number of required components increases and the size of the apparatus accordingly increases.

There may be employed a method in which a cleaning plate or the like is pressed onto the photosensitive element to scrape off all waste toner particles irrespective of their polarity. However, since the photosensitive element is damaged by a use of such a cleaning plate, this method is not preferable.

SUMMARY OF THE INVENTION

The present invention has been developed in view of the above described situations, and an object of the invention is, therefore, to make it possible to remove waste toner particles charged in both the regular and reverse polarities which are remaining or adhering to the photosensitive element after the developer image is transferred onto the transfer object by the transferring device, without providing any additional component to the conventional apparatus.

To attain the above object, the invention provides an image forming apparatus comprising: a photosensitive element; a charger which electrostatically charges a surface of the photosensitive element uniformly at a voltage of a polarity; an exposure device which exposes the surface of the photosensitive element as electrostatically charged by the charger, to a light, so as to form an electrostatic latent image; a developing device which deposits a developer of a color on the electrostatic latent image formed by the exposure device on the photosensitive element, to form a developer image; a transferring device which transfers the developer image on the photosensitive element onto a transfer object; and a developer removing device which removes a waste developer adhering to the surface of the photosensitive element after the developer image is transferred onto the transfer object.

The developer removing device comprises a cleaning member to which a cleaning bias voltage is applied to generate a cleaning bias as a value of a voltage bias between the cleaning member and the photosensitive element. The cleaning member is disposed to act on a part of the surface of the photosensitive element which has been charged by the charger and at which the developer image is not formed yet by the developing device, for removing the waste developer thereon.

According to the image forming apparatus where the cleaning member operates to remove the waste developer after the charger charges the surface of the photosensitive element, there is only a regularly charged waste developer on the part of the surface of the photosensitive element where the cleaning member acts on.

That is, the charger charges all of the following kinds of waste developers, in the regular polarity. (i) A regularly charged waste developer which has been charged in a regular polarity by the charger and left on the surface of the photosensitive element, by failing to be transferred onto the transfer object when the developer image was transferred onto the transfer object, in the previous image forming cycle. This kind of waste developer may be called a "residual tone". (ii) A reversely charged waste developer whose polarity has been reversed from the regular polarity to the reverse polarity, and thus has not been transferred onto the transfer object, when the developer image was transferred onto the transfer object in the previous cycle, due to a discharge current, or otherwise. (iii) A reversely charged waste developer which has been retransferred to the photosensitive element from the transfer object; this kind of waste developer may be called a "retransferred developer or toner", and the polarity of charge thereof is reverse with respect to the regular polarity in which the "residual toner" is charged. Therefore, at a timing to be acted on by the cleaning member, all kinds of waste developers on the photosensitive element have been charged in the regular polarity. Thus, both of the regularly and reversely charged developers left on or adhering to the photosensitive element immediately after the developer image is transferred onto the transfer object are made charged in the regular polarity to be attracted onto the cleaning member to which the cleaning bias voltage is being applied, so that all kinds of waste developers are removed from the surface of the photosensitive element.

The present invention also provides a color image forming apparatus comprising: a plurality of image forming units, each of which comprises: (a) a photosensitive element; (b) a charger which electrostatically charges a surface of the photosensitive element uniformly at a voltage of a polarity; (c) an exposure device which exposes the surface of the photosensitive element as electrostatically charged by the charger, to a light, so as to form an electrostatic latent image; (d) a developing device which deposits a developer of a respective color on the electrostatic latent image formed by the exposure device on the photosensitive element, to form a respective developer image; (e) a transferring device which transfers the respective developer image on the photosensitive element onto a transfer object; (f) a first developer removing device comprising a first cleaning member to which a cleaning bias voltage is applied to generate a cleaning bias as a value of a voltage bias applied between the cleaning member and the photosensitive element, to remove a waste developer adhering to the surface of the photosensitive element after the respective developer image is transferred onto the transfer object. The apparatus further comprises: a belt circulation mechanism comprising: a belt capable of being circulated along a path including a straight line extending along a row of the transferring devices of the respective image forming units; and a belt drive device for circulating the belt; a second developer removing device which comprises a second cleaning member brought into contact with the belt at a predetermined point in the path of circulation of the belt, so as to remove the developer adhering to the surface of the belt circulated; and a first cleaning member cleanup controller which operates to apply respective bias voltages to the first cleaning member, the photosensitive element, the belt, and the second cleaning member, such that a waste developer adhering to the first cleaning member is transferred to the second cleaning member via the photosensitive element and the belt.

The invention further provides a processing device comprising: a photosensitive element having a surface movable in a direction; a charger which is disposed to be opposed to the surface of the photosensitive element, and capable of charging the surface; a developing device which is disposed to be opposed to the surface of the photosensitive element, and capable of supplying a developer to the surface; and a cleaning device which is disposed between the charger and the developing device with respect to the direction in which the surface of the photosensitive element is moved, and capable of collecting a part of the developer which adheres to the surface as a waste developer.

Similarly to the above-described apparatuses, according to this arrangement, the developer left on or adhering to the photosensitive element can be uniformly charged in the same polarity to be attracted onto the cleaning device, so that all kinds of waste developers are removed from the surface of the photosensitive element.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be described one embodiment of the invention by way of example, referring to the accompanying drawings.

Figure 1:
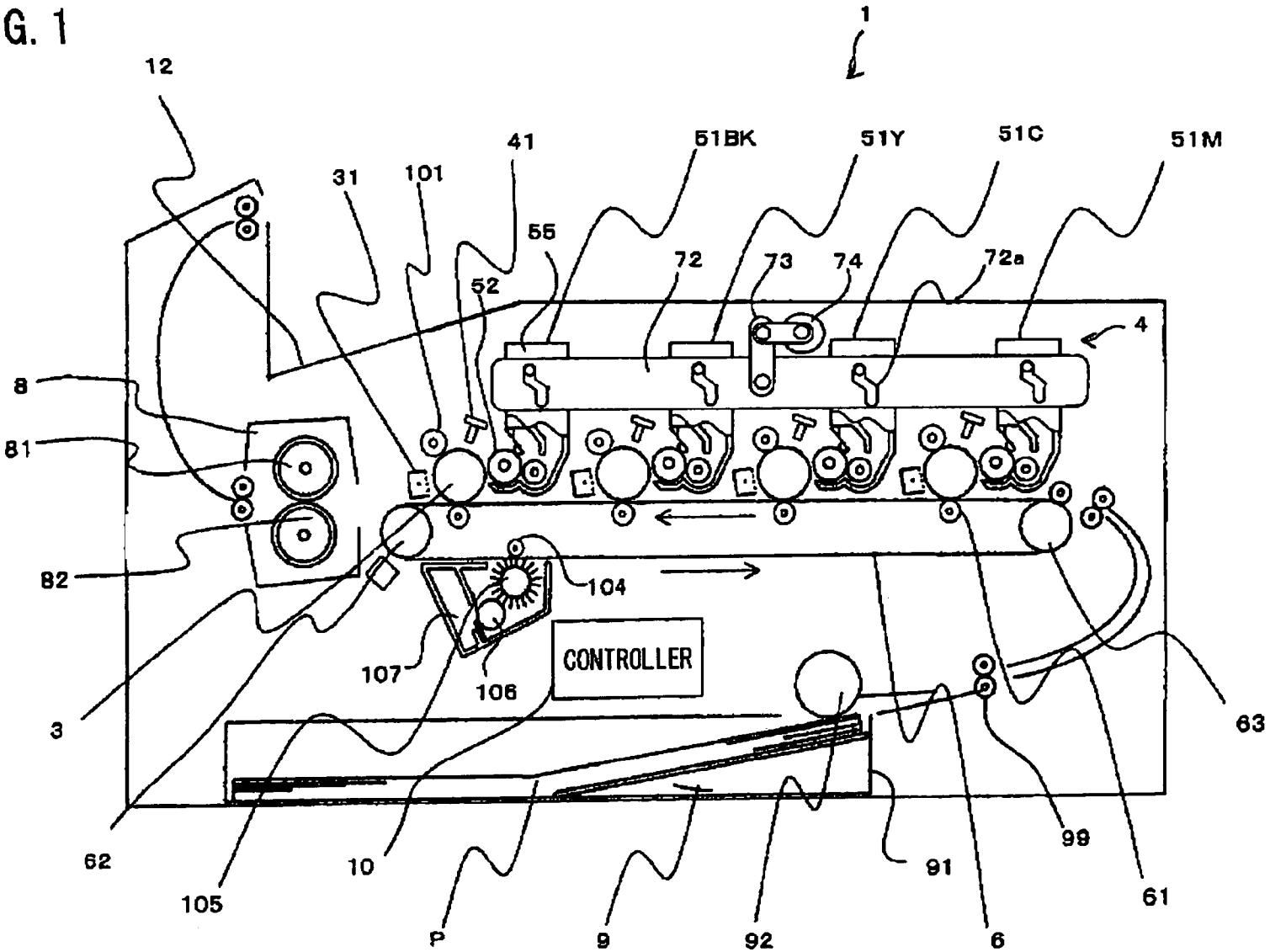
FIG. 1 is a schematic sectional view of a color laser printer 1 according to one embodiment of the invention.

FIG. 1 is a schematic sectional view of an inner structure of a color laser printer 1 as an image forming apparatus according to this invention.

The color laser printer 1 shown in FIG. 1 comprises a visible image forming assembly 4, a sheet carrier belt 6, a fixing unit 8, a sheet feeding unit 9, a stacker 12, and a controller 10. The printer 1 forms on a sheet P of paper as a recording medium, four images of respective colors in accordance with image data input from an external device.

Figure 2:
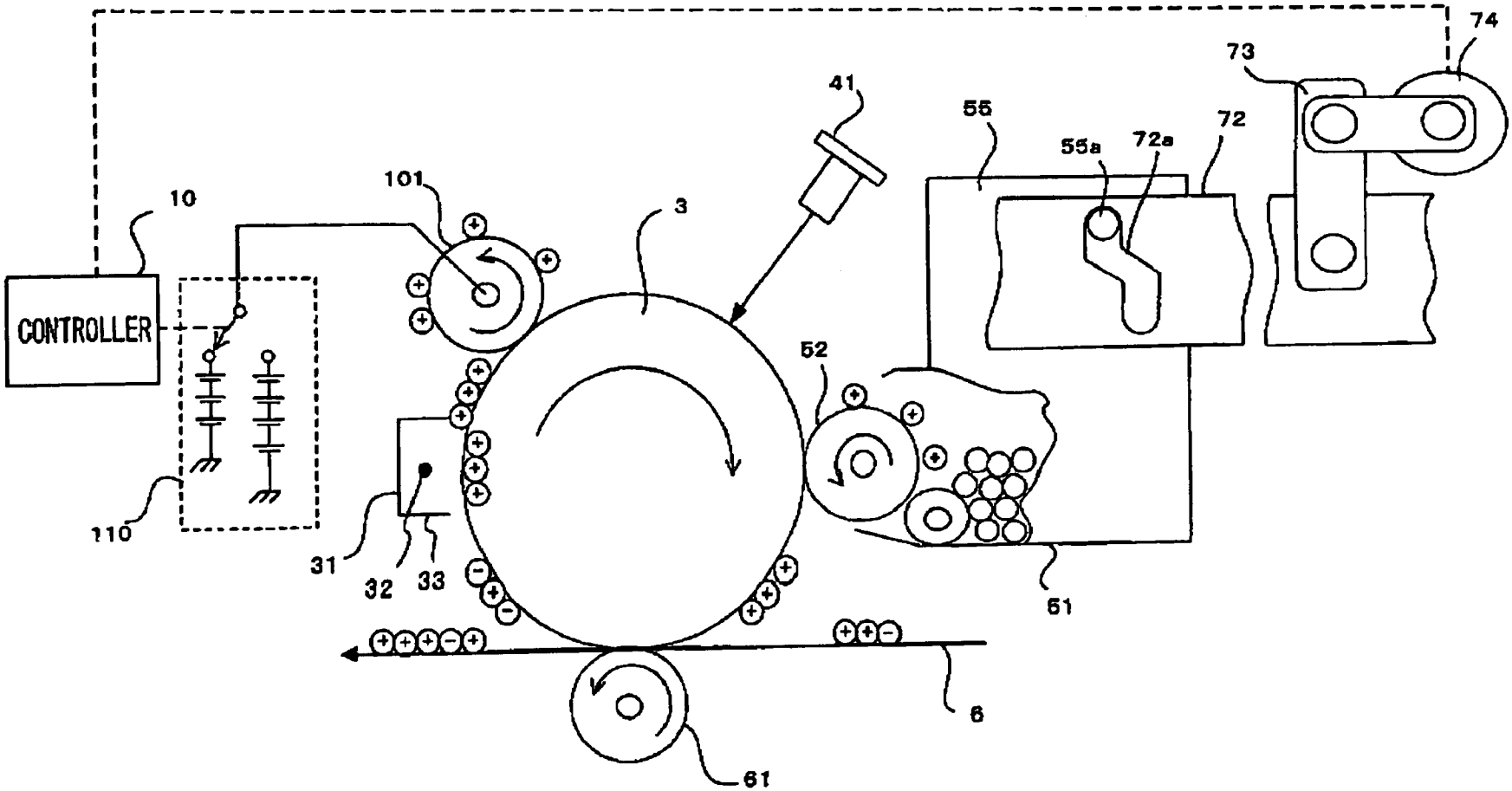
FIG. 2 is an explanatory view of a part of a visible image forming assembly 4 of the color laser printer 1, related to forming of an image of one of four colors.

The visible image forming assembly 4 comprises developing units 51M, 51C, 51Y, and 51BK as four developing devices. The developing units store toners, as a developer, of magenta, cyan, yellow, and block, respectively, and form visible or toner images in the respective colors. As shown in FIG. 2, the visible image forming assembly 4 further comprises, for each step of forming a toner image of the respective color, a photoconductor drum 3 as a photosensitive element, a charger 31, a cleaning roller 101 as a cleaning member of a developer removing device, and an exposure device 41.

There will be described in detail a construction of each element of the printer 1.

Each of the photoconductor drums 3 of the visible image forming assembly 4 is constituted by a substantially cylindrical member and rotatably supported. Four photoconductor drums 3 of the developing units are substantially equally spaced apart from one another along a line extending in a horizontal direction. The substantially cylindrical member of the photoconductor drum 3 is provided by, for instance, an aluminum substrate coated with a photosensitive layer of positively charged type. The aluminum substrate is connected to a ground line of the color laser printer 1.

The charger 31 is a scorotron type charger, and is opposed to the photoconductor drum 3. The charger 31 comprises a charger wire 32 extending in the longitudinal direction of the photoconductor drum 3, and a shield case 33 accommodating the charger wire 32 and open only on the side opposed to the photoconductor drum 3. By applying a high voltage to the charger wire 32, a surface of the photoconductor drum 3 is charged in the positive polarity (e.g., +700 V). The shield case 33 has a grid on the side open toward the photoconductor drum 3. When a constant voltage is applied to the grid, the electric potential on the surface of the photoconductor drum 3 is made substantially identical with a grid voltage.

The cleaning roller 101 is constituted by an electrically conductive sponge material shaped in a substantially cylindrical form extending in the longitudinal direction of the photoconductor drum 3. The cleaning roller 101 is disposed to be held in contact with the photoconductor drum 3, on the downstream side of the charger 31 in the direction of rotation of the photoconductor drum 3.

To the cleaning roller 101 is applied, as a cleaning bias voltage, a voltage (for instance, +400 V) lower than the surface potential of the photoconductor drum 3 charged by the charger 31, so that a cleaning bias is generated between the cleaning roller 101 and the photoconductor drum 3. The cleaning roller 101 is supported such that the cleaning roller 101 is rotatable by a drive source (not shown) such that a rotational speed of the surface of the cleaning roller 101 is slightly lower than that of the photoconductor drum 3.

The cleaning bias voltage is applied to the cleaning roller 101 from a constant voltage source 110 capable of switching a potential to apply to the cleaning roller 101 in accordance with a command signal from the controller 10.

The exposure device 41 is disposed downstream of the charger 31 in the direction of rotation of the photoconductor drum 3, and is constructed such that a laser light, which corresponds to image data for a respective one of the four colors input from the external device, is emitted from a light source, and is swept across the surface of the photoconductor drum 3 by being reflected by a surface of a polygon mirror or the like swung by a polygon motor.

The surface potential of the photoconductor drum 8 is lowered (for instance, to +200 V) at a part irradiated by the laser light emitted from the exposure device 41 correspondingly to the image data, thereby forming the electrostatic latent image on the surface of the drum 3.

Each of the developing units 51M, 51C, 51Y, 51BK comprises a casing 55 containing a respective toner, and a developing roller 52, and is disposed such that the developing roller 52 is held in contact with the photoconductor drum 3, on the downstream side of the exposure device 41 in the direction of rotation of the photoconductor drum S. The developing unit 51M, 51C, 51Y, 51BK positively (i.e., in the regular polarity) charges particles of the toner so as to supply the toner particles in the form of a thin layer of a uniform thickness to the developing roller 52. At an area where the developing roller 62 and the photoconductor drum 3 are in contact with each other, the positively charged toner particles on the developing roller 52 are attracted to the positively charged electrostatic latent image formed on the photoconductor drum 3, to form the toner image. That is, the toner or developer image is formed by reversal development.

The developing roller 52 is constituted by a cylindrical member which is formed of an electrically conductive silicon rubber or the like and coated with a resin containing fluorine, or a rubber material.

The toners contained in the casings 55 of the respective developing units 51M, 51C, 51Y, 51BK are a nonmagnetic monocomponent developer of positively charged type, having the colors of magenta, cyan, yellow and black, respectively.

The sheet feeding unit 9 is disposed at the bottom of the apparatus 1, and comprises a sheet tray 91 accommodating sheets P of paper, and a pickup roller 92 for feeding the sheets P one by one. The sheet P is eventually fed onto a sheet carrier belt 6 via a pair of carrier rollers 99 and others.

The sheet carrier belt 6 is an endless belt having a width smaller than the length of the photoconductor drum 3, and is configured to carry the sheet P on an upper surface thereof by being entrained around a drive roller 62 and an idle roller 63. There is disposed a transfer roller 61 at each position where the sheet carrier belt 6 substantially opposes each photoconductor drum 3. The sheet carrier belt 6 circulates according to the rotation of the drive roller 62 in a direction as indicated by arrows shown in FIG. 1, such that the surface to be opposed to the photoconductor drums 3 travels from right to left as seen in FIG. 1, so as to convey the sheet P fed from the carrier rollers 99, by sequentially passing under the photoconductor drums 3, to eventually feed the sheet P to the fixing unit 8. There is disposed a second cleaning member in the form of a cleaning brush 105 at a position immediately after the sheet carrier belt 6 takes a turn where the drive roller 62 is disposed.

The transfer roller 61 is applied with a voltage of a polarity reverse with respect to the polarity in which the charger 31 charges the photoconductor drum 8, so that a suitable transfer bias is applied between the transfer roller 61 and the photoconductor drum 3 by a so-called constant current control (e.g., at −10 to −15 μA), or by a constant voltage control. Thus, the toner image formed on the photoconductor drum 8 is transferred onto the sheet P carried by the sheet carrier belt 6.

The cleaning brush 105 is constructed such that bristles are provided around a substantially cylindrical member extending in the width direction of the sheet carrier belt 6. Between the cleaning brush 105 and an electrode roller 104 disposed at a position to be opposed to the cleaning brush 105 via the sheet carrier belt 6, there is applied a voltage bias for generating a predetermined electric potential therebetween. The cleaning brush 105 is disposed to be rotated in contact with the sheet carrier belt 6, and is equipped with a waste toner collector roller 106 for removing and collecting the toner particles adhering to the cleaning brush 105, and a waste toner box 107 for storing the waste toner removed from the cleaning brush 105. That is, if the waste toner particles attracted from the photoconductor drum 3 are left adhering to the cleaning roller 101, the cleaning performance of the cleaning roller 101 gradually deteriorates. Therefore, it is necessary to remove the waste toner particles on the cleaning roller 101 therefrom and store the removed waste toner particles in the waste toner box 107 so that the stored waste toner particles are discharged to the outside of the printer 1 at a later time.

The fixing unit 8 comprises a heating roller 81 and a pressing roller 82 between which the sheet P is fed with a heat and a pressure applied to the sheet P, so that an image constituted by the four toner images of respective colors as superposed on the sheet P is fixed on the sheet P.

The stacker 12 is formed on the upper side of the printer 1, and located at a position to receive the sheet P ejected from the fixing unit 8.

The controller 10 may be constituted by a control device using a known CPU, and controls overall operations of the color laser printer 1, including outputting a command signal indicating a value of a voltage to be applied to the cleaning roller 101 from the constant voltage source 110.

The developing unit 51M, 51C, 51Y, 51BK is supported such that the developing roller 52 is movable in a horizontal direction to be separated away from the photoconductor drum 3, and is positioned by means of a guide plate 72 extending across all developing units 51M, 51C, 51Y, 51BK.

More specifically, the guide plate 72 is a plate like member having a length across the four developing units 51, 51C, 51Y, 51BK, and is held movably in the vertical direction. There are formed in the guide plate 72 four guiding holes 72*a* each having a generally crank-like shape extending in the vertical direction. An end of a shaft 55*a* provided on a side face with respect to the longitudinal direction of the photoconductor drum 3 of each casing 65, is inserted in a corresponding one of the guiding holes 72*a* to be supported thereby.

The guide plate 72 is associated with a motor 74 via a linkage 73 for converting a rotary motion of the motor 74 into a vertical motion. The controller 10 is configured to output a command signal instructing the motor 74 to operate, and the guide plate 72 moves upward or downward in accordance with the rotation of the motor 74 in response to the command signal from the controller 10.

When the guiding holes 72*a* move upward as the guide plate 72 is moved upward, the shaft 55*a* of each casing 55 roves in the horizontal direction along the crank-like shape of the respective guiding hole 72*a*. Accordingly, the developing unit 51M, 51C, 51Y, 51BK is moved such that the developing roller 62 is separated away from the photoconductor drum 3. On the other hand, when the guide plate 72 is held at its lowest position, each of the developing units 51M, 51C, 51Y, 51BK is in a state where the developing roller 52 is held in contact with the photoconductor drum 3.

In the color laser printer 1 constructed as described above, an image is formed on the sheet P in the following manner.

First, one of the sheets P of paper is supplied from the sheet feeding unit 9 by means of the pickup roller 92, and fed onto the sheet carrier belt 6 via the carrier rollers 99.

Figure 3:
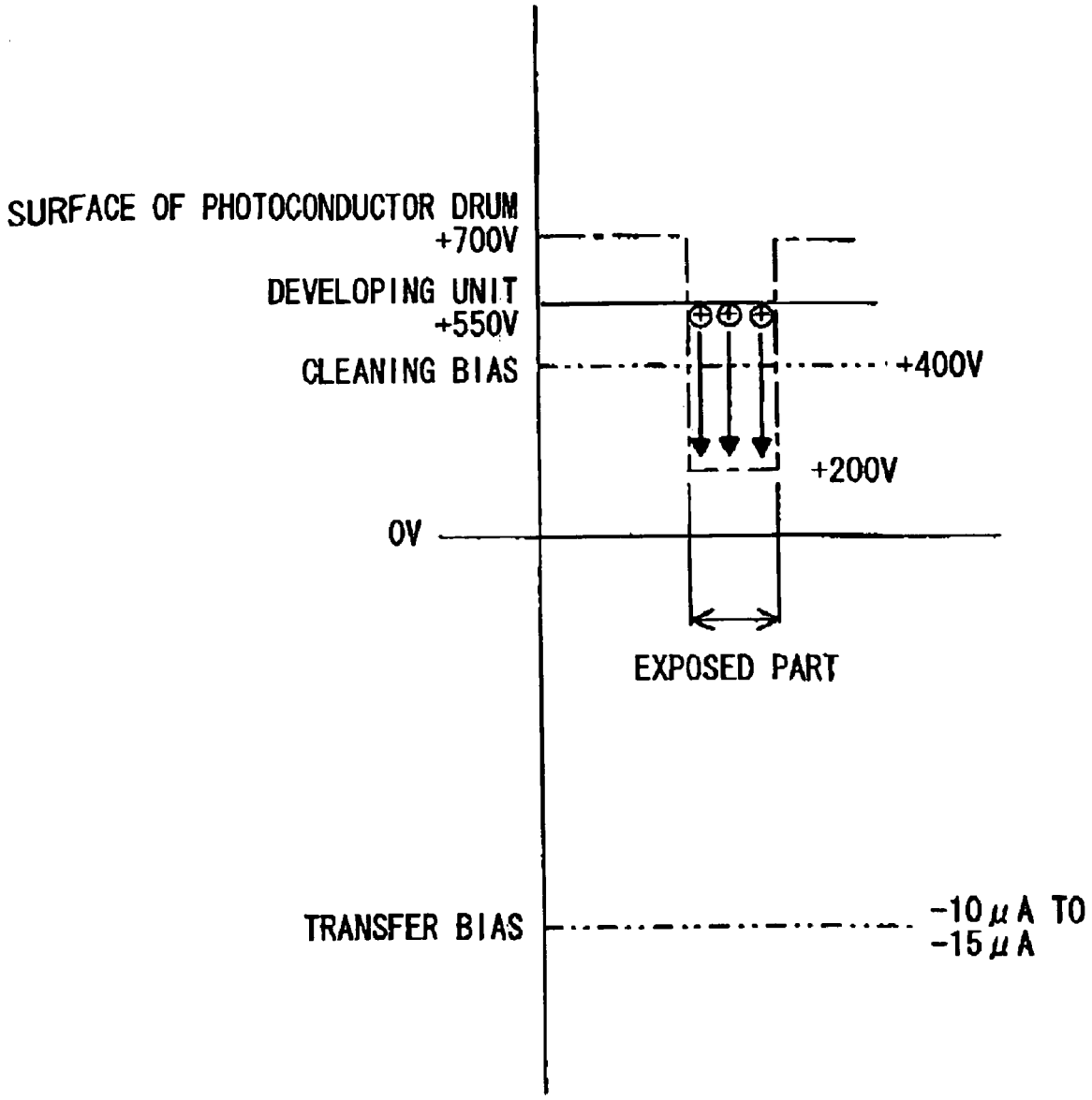
FIG. 3 indicates a relationship among various voltages at relevant elements, in an image forming operation in the embodiment.

The surface of the rightmost photoconductor drum 3 in FIG. 1 (i.e., the photoconductor drum 3 of the developing unit 51M for forming a magenta color image) is uniformly charged to +700 V, for instance, by the charger 31, and then exposed to a light corresponding to magenta image data inputted from the external device so that the electric potential at the part exposed to the light is lowered to about +200 V to thereby form an electrostatic latent image. Then, in the developing unit 51M, magenta toner particles as regularly charged are supplied from the developing roller 62, to which a developing bias voltage of +500 V is applied, to the surface of the photoconductor drum 3, such that the magenta toner particles adhere to the part where the electrostatic latent image is formed and the electric potential is lower than the developing bias voltage, to thereby develop the latent image. The thus formed positively charged toner image is transferred onto the sheet P carried by the sheet carrier belt 6, by means of the transfer roller 61 to which a transfer bias voltage is applied. The values of voltage applied to respective elements (or potential difference among the elements) are indicated in FIG. 3.

After the toner image is transferred onto the sheet P, waste magenta toner particles of two kinds are adhering to the photoconductor drum 3, as shown in FIG. 2, namely, (i) a positively and regularly charged one which has not been successfully transferred onto the sheet P by the transfer roller 61, and (ii) a negatively charged one whose polarity of charge has been reversed to negative during the transfer of the toner image onto the sheet P, due to a discharge current or otherwise, and which has not been thus transferred onto the sheet P.

The residual magenta toner particles on the photoconductor drum 3 are charged when passing by the charger 81 as the drum 3 rotates, such that both kinds of the charged waste magenta toner particles as oppositely charged are charged positively.

Since the electric potential (e.g., +400 V) of the cleaning roller 101 is lower than the surface potential (e.g., +700 V) of the photoconductor drum 3, the waste magenta toner particles are electrically attracted onto the cleaning roller 101 as passing by the cleaning roller 101. According to this arrangement, the surface potential of the photoconductor drum 3 as charged to a predetermined value of potential by the charger 31 is prevented from being lowered by the operation of the cleaning roller 101 to remove the waste toner from the photoconductor drum 3. Thus, a cleaning capability can be ensured while an adverse effect on the electrostatic latent image as will be formed is prevented.

In the state where the waste magenta toner particles have been removed from the surface of the photoconductor drum 3, the electrostatic latent image is formed, and then the toner image is formed when the latent image passes by the developing unit 51M.

Subsequently, the sheet P carrying the magenta toner image is conveyed by the sheet carrier belt 6 to be brought into contact with the photoconductor drum 3 of the developing unit 51C for forming the image of cyan. There, a part of the magenta toner particles which have been transferred onto the sheet P and form the magenta image thereon is reversely charged and retransferred, as the waste magenta toner particles, onto the photoconductor drum 3 of the developing unit 51C.

Hence, after the cyan image is transferred onto the sheet P, three kinds of waste toner particles are adhering to the surface of the photoconductor drum 3 of the developing unit 51C. Namely, (a) regularly charged cyan toner particles, more specifically, positively charged cyan toner particles which have not been successfully transferred onto the sheet P by the transfer roller 61; (b) reversely charged cyan toner particles, whose polarity has been reversed to negative; and (c) reversely charged magenta toner particles, which are negatively charged and have been retransferred from the sheet P.

Similarly to the step as described with respect to the magenta image, all of the three kinds of the waste toner particles are uniformly charged by the charger 31 and attracted onto the cleaning roller 101 from the photoconductor drum 3, and the cyan toner image is formed on the photoconductor drum 3 and transferred onto the sheet P.

Then, in the same way as the cyan image is formed on the sheet P, the toner image of yellow is formed on the photoconductor drum 3 of the developing unit 51Y and transferred onto the sheet P by the relevant transfer roller 61 to be superposed on the cyan toner image. Then, the toner image of black is similarly formed on the photoconductor drum 3 of the developing unit 51BK and transferred onto the sheet P to be superposed on the yellow toner image.

At last, the four toner images of respective colors formed on the sheet P are fixed on the sheet P by the fixing unit 8, and the sheet P is ejected onto the stacker 12.

After the image has been completed on the sheet P as described above, during at least a time period while a part of the surface of the photoconductor drum 3 which will be brought into contact with an area on the sheet carrier belt 6 where an image is not to be formed in a sheet P, passes by the cleaning roller 101, that is, while a part of the surface of the photoconductor drum 3 corresponding to an area on the sheet carrier belt 6 where a carried sheet P is not present, passes by the cleaning roller 101, the controller 10 issues a command signal to the voltage source 110 to change the voltage applied to each cleaning roller 101, as well as issues a command signal to the motor 74 to move the guide plate 72 upward. The above indicated time period may correspond to, for instance, a timing when images have been formed on a predetermined number of sheets P, or when a predetermined time has lapsed.

More specifically, the voltage applied to each cleaning roller 101 is changed to be higher (e.g., to +1 kV) than the surface potential (e.g., +700 V) of the photoconductor drum 3 as charged by the charger 31. By this change, the absolute value of the potential applied to the cleaning roller 101 becomes higher than the absolute value of the surface potential of the photoconductor drum 3, making the polarity of a voltage bias between the cleaning roller 101 and the photoconductor drum 3 reverse to that of the cleaning bias. That is, there is generated a voltage bias for making the waste toner particles which have been transferred onto the cleaning roller 101 to be returned to the photoconductor drum 3 away from the cleaning roller 101.

Thus, the waste toner particles adhering to the cleaning roller 101 are removed therefrom to now adhere to the photoconductor drum 3, while the developing roller 52 of each developing unit SM, 51C, 51Y, 51BK is separated away from the photoconductor drum 3 by the movement of the guide plate 72. Hence, even when reaching the position to be opposed to the developing roller 52, the waste toner particles transferred back onto the photoconductor drum 3 do not adhere to the developing roller 52, and are further carried to the position to be opposed to the transfer roller 61 where the waste toner particles are transferred onto the sheet carrier belt 6 by the transfer roller 61.

As the sheet carrier belt 6 is circulated, the waste toner particles thereon are brought into contact with the cleaning brush 105 and collected thereby. The waste toner particles collected by the cleaning brush 105 are then removed from the cleaning brush 105 by the waste toner collector roller 106 to be stored in the waste toner box 107.

As described above, the color laser printer 1 is capable of removing both positively and negatively charged waste toner particles adhering to the photoconductor drum 3, simply by using the cleaning roller 101, after the toner image is transferred onto the sheet P by the transfer roller 61.

Thus, the influence of the reversely charged toner particles adhering to the photoconductor drum 3 after the toner image is transferred onto the sheet P by the transfer roller 61 can be eliminated, enhancing the quality of an image formed by the color laser printer 1.

Particularly in the case where plural images are sequentially formed using toners of respective colors, as in the present embodiment, the problems seriously affecting the quality of the formed image, such as that a part of toner particles forming a toner image of a color which has been once transferred is retransferred onto the photoconductor drum 3 of a developing unit for another or the next color, which causes color mixing, is advantageously prevented.

In the above described embodiment, the waste toner particles adhering to the cleaning roller 101 are collected, by changing the voltage applied to the cleaning roller 101 to a value (e.g. +1 kV) higher than the surface potential (e.g., +700 V) of the photoconductor drum 3 charged by the charger 31 so that the absolute value of the electric potential applied to the cleaning roller 101 is made higher than the absolute value of the surface potential of the photoconductor drum 3, in order to reverse the polarity of the voltage bias between the cleaning roller 101 and the photoconductor drum 3 with respect to the polarity of the cleaning bias, to thereby repel the waste toner particles adhering to the cleaning roller 101 therefrom to make the waste toner particles to be returned to the photoconductor drum 3. However, the way of collecting the waste toner particles adhering to the cleaning roller 101 is not limited to the above described one. It may be arranged such that the surface potential of the photoconductor drum 3 is made lower than that of the cleaning roller 101, in other words, the surface potential of the cleaning roller 101 is made higher than that of the photoconductor drum 3, by lowering the surface potential of the photoconductor drum 3, which may be accomplished by suspending the charging operation of the charger 31, or lowering the grid voltage.

Although one embodiment of the invention has been described, the invention is not limited to the details of the embodiment, but the invention may be variously embodied.

Figure 4:
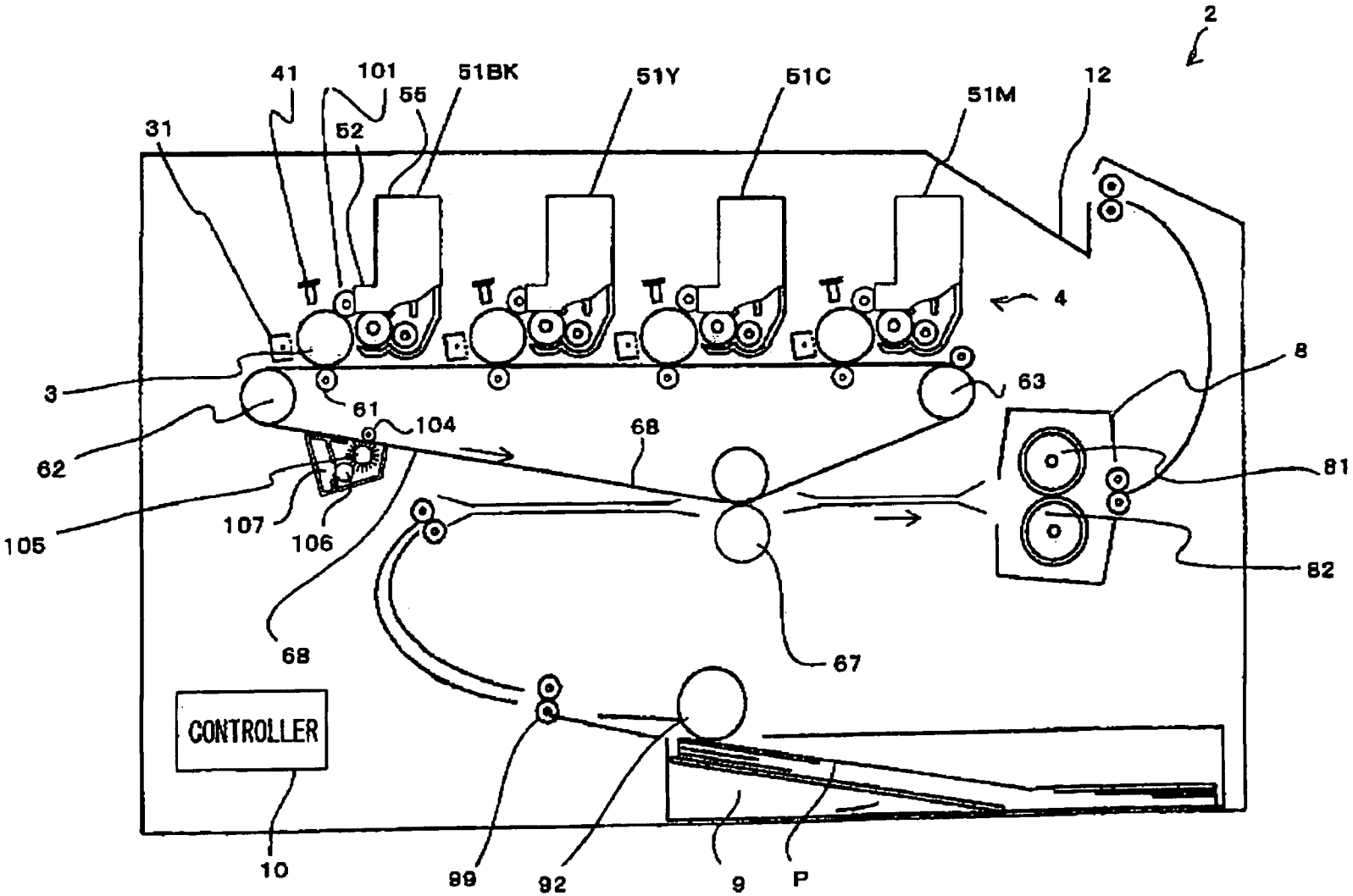
FIG. 4 is a schematic sectional view of a color laser printer of a first modification of the embodiment of the invention.

For instance, although in the color laser printer 1 of the above described embodiment the image is formed on the sheet P carried by the sheet carrier belt 6, by directly transferring four toner images from the respective photoconductor drums 3 onto the sheet P, the color laser printer according to the invention may be constructed as shown in FIG. 4. That is, in a color laser printer 2 according to a first modification of the embodiment of the invention as shown in FIG. 4, the image is formed on the sheet P such that the four toner images formed on the respective photoconductor drums 3 are once transferred to an intermediate transfer belt 68 as an intermediate transfer member, and at the position where the intermediate transfer belt 68 travels through between a pair of secondary transfer rollers 67, the toner images on the intermediate transfer belt 68 are transferred onto a sheet P of paper together passing through between the secondary transfer rollers 67 under a pressure. According to the first modification of the embodiment as shown in FIG. 4, the effects similar to those of the embodiment shown in FIG. 1 can be obtained.

Further, although both of the color laser printers 1, 2 employ the so-called "tandem system", wherein the four toner images of respective colors are formed on the respective photoconductor drums 3 and the toner images are sequentially transferred onto the sheet P in a superposed manner such that each time the sheet P passes by one of the photoconductor drums 3 the corresponding toner image is transferred onto the sheet P. However, in a second modification of the embodiment of the invention, it is arranged such that the cleaning roller 101 is disposed at a position corresponding to that in the above described embodiment, in a color laser printer employing the so-called "four cycle system", wherein only one photoconductor drum 3 is provided, and a sheet P of paper or an intermediate transfer belt 68 is repeatedly carried to a position to be opposed to the photoconductor drum 3, and toner images of respective colors are formed on the single photoconductor drum 3 one by one. Each time a toner image of one of four colors is formed on the drum 3, this toner image is transferred onto the sheet P or intermediate transfer belt 68, sequentially superposed on the previously transferred image or images, to eventually form a complete color image.

Figure 5:
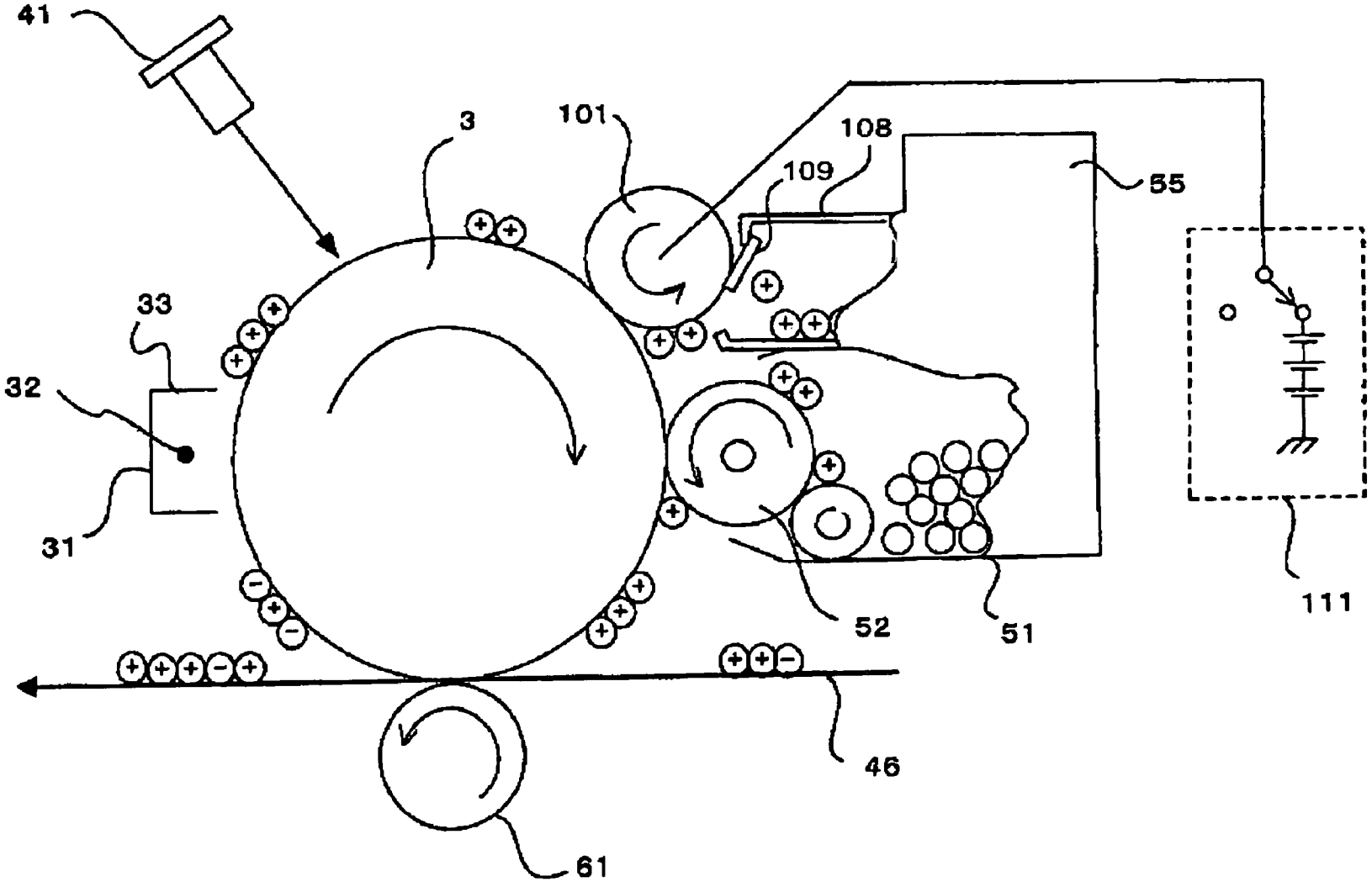
FIG. 5 is an explanatory view of a part of a visible image forming assembly 4, related to forming of an image of one of four colors, of the color laser printer of a fourth modification of the embodiment of the invention.

A color laser printer according to a third modification of the embodiment of the invention is arranged such that only a single photoconductor drum 3 is provided and a monochrome image is formed on a sheet P of paper. In the color laser printer 1 according to the above described embodiment, the waste toner particles adhering to the cleaning roller 101 are discharged on the sheet carrier belt 6 via the photoconductor drum 3, by changing the voltage applied from the constant voltage source 110, as well as separating the developing unit 51M, 51C, 51Y, 51BK from the photoconductor drum 3, at a suitable timing after an image is formed on the sheet P, and the waste toner particles discharged on the sheet carrier belt 6 are collected by the cleaning brush 105. However, according to a fourth modification of the embodiment of the invention, as shown in FIG. 5, it is arranged such that the cleaning roller 101 of each developing unit 51M, 51C, 51Y, 51BK is disposed downstream of the exposure device 41 in the direction of rotation of the photoconductor drum 3, and provided with a waste toner container 108 for storing the waste toner particles which are scraped off the cleaning roller 101 by a cleaning plate 109.

In this case, the absolute value of the potential applied to the cleaning roller 101 is made smaller than the absolute value of the surface potential of the exposed part on the photoconductor drum 3, so as to enable to remove even the waste toner particles adhering to the exposed part, to obtain the same effects as those of the embodiment shown in FIG. 2. For instance, a cleaning bias voltage of +100 V is applied to the cleaning roller 101, or alternatively, a potential in the reverse polarity may be applied to the cleaning roller 101.

The waste toner container 108 is formed integrally with the casing 65 of the developing unit 51M, 51C, 51Y, 51BK.

According to this arrangement, the function to reverse the polarity of the voltage applied by the constant voltage source 110 for collecting the waste toner particles, and the guide plate 72 for displacing the developing unit 51M, 51C, 51Y, 51BK away from the photoconductor drum 3, the linkage 73, and the motor 74 can be all omitted, simplifying the structure of the color laser printer 1. Since in the present arrangement the waste toner container 108 is formed integrally with the developing unit 51M, 51C, 51Y, 51BK the collected waste toner can be taken out of the printer together with the developing unit 51M, 51C, 51Y, 51BK when a maintenance work for the developing unit 51M, 51C, 51Y, 51BK, such as a replacement of the developing unit 51M, 51C, 51Y, 51BK with another, and a periodic replenishment of toner, is performed, thereby facilitating the maintenance work of the color laser printer as a whole. The arrangement where the waste toner container 108 and the developing unit 51M, 51C, 51Y, 51BK are integrally formed reduces the number of components of the color laser printer, making it possible to reduce the overall size of the color laser printer. Further, the arrangement that the cleaning roller 101 is disposed downstream of the exposure device 41 enables the cleaning roller 101 to be disposed adjacent the respective developing unit 51M, 51C, 51Y, 51BK, facilitating integrally forming the cleaning roller 101 and the respective developing unit 51M, 51C, 51Y, 51BK.

Nonetheless, the above described embodiment shown in FIG. 2 is more preferable than the fourth modification, in that the waste toner particles removed from the photoconductor drum 3 by the cleaning roller 101 are collected at a single site, namely, collected solely by the cleaning brush 105, reducing the total space required for storing the waste toner compared to the arrangement where the waste toner container 108 is provided for each cleaning roller 101, and also in that the waste toner can be taken out of the printer by a single step. Further, compared to the fourth modification, the waste toner particles on the photoconductor drum 3 can be more reliably removed in the above described embodiment where the cleaning member operates to remove the waste toner particles before the exposure device 41 exposes the surface of the photoconductor drum 3 to the light. Still further, according to the above described embodiment, the waste toner box 107 need not be disposed near the photoconductor drum 3 around which many other devices should be disposed, making it easy to design the color laser printer.

Figure 6:
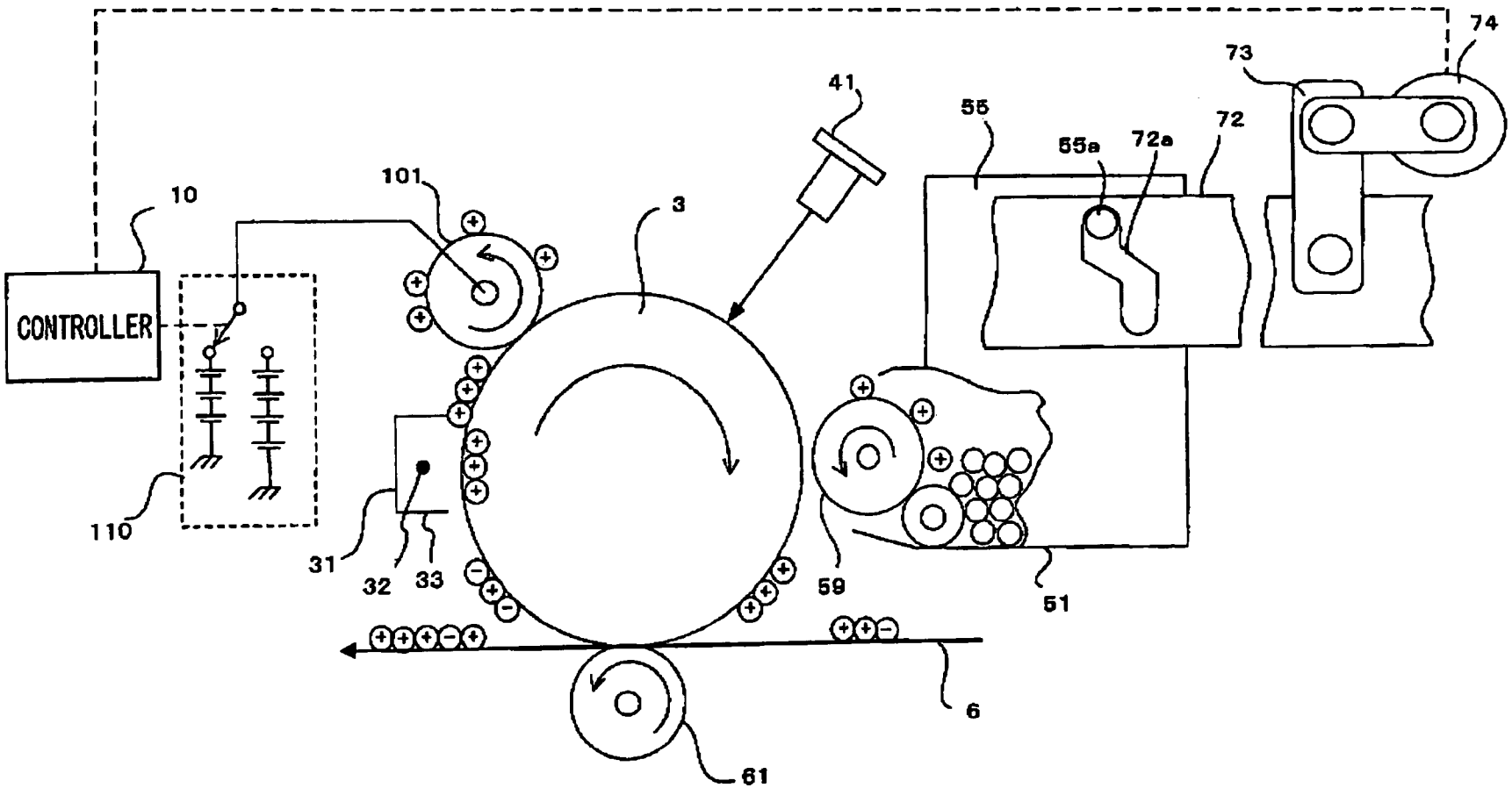
FIG. 6 is an explanatory view of a part of a visible image forming assembly 4, related to forming of an image of one of four colors, of the color laser printer of a fifth modification of the embodiment of the invention.

The color laser printer of the above described embodiment is of contact development kind wherein the developing roller 52 of the respective developing unit 51M, 51C, 51Y, 51BK is held in contact with the photoconductor drum 3 to perform the development of the latent image. However, according to a fifth modification of the embodiment of the invention as shown in FIG. 6, the principle of the invention is applied to a color laser printer of non-contact development kind wherein a developing roller 59 is not in contact with the photoconductor drum 3 during the development of the latent image. In this case, when the waste toner particles adhering to the cleaning roller 101 are collected, the developing roller 62 need not be displaced to be separated away from the photoconductor drum 3. In this case, the developing bias voltage applied to the developing roller 52 is lowered compared to a regular voltage applied when developing a latent image, or completely cut off so that the waste toner particles repelled back onto the photoconductor drum 3 can pass through between the developing roller 52 and the photoconductor drum 3. Therefore, the separator including the guide plate 72 in the above described embodiment shown in FIGS. 1 and 2 can be omitted, simplifying the mechanical structure of the printer.

According to a sixth modification of the embodiment, a waste toner collector comprising a cleaning plate 109 and a waste toner container 108, similar to that shown in FIG. 5, is provided for each cleaning roller 101 disposed at a position between the charger 31 and the exposure device as shown in FIGS. 1 and 2, to collect the waste toner particles adhering to the cleaning roller 101. In this case, a mechanism for gathering the waste toner particles stored in the respective waste toner containers 108 of the four developing units may be provided, so that the gathered waste toner particles can be discharged to the outside of the printer by a single step.

What is claimed is:

1. An image forming apparatus for forming an image on a recording medium carried by a medium carrier, the image forming apparatus comprising:

a photosensitive element;

a charger which electrostatically charges a surface of the photosensitive element uniformly at a voltage of a polarity;

an exposure device which exposes the surface of the photosensitive element as electrostatically charged by the charger, to a light, so as to form an electrostatic latent image;

a developing device which deposits a developer of a color on the electrostatic latent image formed by the exposure device on the photosensitive element, to form a developer image;

a transferring device which transfers the developer image on the photosensitive element onto the recording medium carried by the medium carrier;

a developer removing device which comprises a cleaning member to which a cleaning bias voltage is applied to generate a cleaning bias as a value of a voltage bias between the cleaning member and the photosensitive element, to remove a waste developer adhering to the surface of the photosensitive element after the developer image is transferred onto the recording medium, the cleaning member being disposed to act on a part of the surface of the photosensitive element which has been charged by the charger and at which the developer image is not formed yet by the developing device, for removing the waste developer thereon;

a cleaning bias reverser capable of reversing a polarity of the voltage bias between the cleaning member and the photosensitive element generated as a result of the application of the cleaning bias voltage to the cleaning member;

a separator capable of moving the developing device away from the photosensitive element;

a waste developer shifter which (i) makes the cleaning bias reverser to reverse the polarity of the voltage bias between the cleaning member and the photosensitive element from the polarity of the cleaning bias, at a timing when a part of the surface of the photosensitive element which will be brought into contact with an area on the medium carrier where the image is not to be formed in the recording medium, passes by the cleaning member, in order to repel the waste developer which has been once attracted onto the cleaning member back onto the photosensitive element, and (ii) makes the separator to move the developing device away from the photosensitive element, so that the waste developer repelled back onto the photosensitive element is discharged on the medium carrier; and a waste developer collector which collects the waste developer which has been discharged on the medium carrier.

2. The apparatus of claim 1, wherein the cleaning bias voltage is applied to the cleaning member, in the same polarity as the charger charges the surface of the photosensitive element, and in a value whose absolute value is smaller than that of a surface potential of the photosensitive element as charged by the charger.

3. The apparatus of claim 1, wherein the exposure device forms a plurality of electrostatic latent images, wherein the developing device forms a plurality of developer images by depositing toners of respective colors on the electrostatic latent images formed by the exposure device, and wherein the transferring device transfers the developer images onto the recording medium by superposing the developer images.

4. The apparatus of claim 1, wherein the cleaning member is disposed to act on a part of the surface of the photosensitive element at which the electrostatic latent image has been formed by the exposure device but the developer image is not formed yet by the developing device.

5. The apparatus of claim 1, wherein the cleaning member is disposed to act on a part of the surface of the photosensitive element which has been charged by the charger and at which the electrostatic latent image is not formed yet by the exposure device.

6. An image forming apparatus in which a developer image is first transferred onto an intermediate transfer member and is then transferred onto a recording medium, the apparatus comprising:

a photosensitive element;

a charger which electrostatically charges a surface of the photosensitive element uniformly at a voltage of a polarity;

an exposure device which exposes the surface of the photosensitive element as electrostatically charged by the charger, to a light, so as to form an electrostatic latent image;

a developing device which deposits a developer of a color on the electrostatic latent image formed by the exposure device on the photosensitive element, to form a developer image;

a transferring device which transfers the developer image on the photosensitive element onto the intermediate transfer member;

a developer removing device which comprises a cleaning member to which a cleaning bias voltage is applied to generate a cleaning bias as a value of a voltage bias between the cleaning member and the photosensitive element, to remove a waste developer adhering to the surface of the photosensitive element after the developer image is transferred onto the intermediate transfer member, the cleaning member being disposed to act on a part of the surface of the photosensitive element which has been charged by the charger and at which the developer image is not formed yet by the developing device, for removing the waste developer thereon;

a cleaning bias reverser capable of reversing a polarity of the voltage bias between the cleaning member and the photosensitive element generated as a result of the application of the cleaning bias voltage to the cleaning member;

a separator capable of moving the developing device away from the photosensitive element;

a waste developer shifter which (i) makes the cleaning bias reverser to reverse the polarity of the voltage bias between the cleaning member and the photosensitive element from the polarity of the cleaning bias, at a timing when a part of the surface of the photoelectric element which will be brought into contact with an area on the intermediate transfer member where an image is not to be formed in the recording medium, passes by the cleaning member, in order to repel the waste developer which has been once attracted onto the cleaning member back onto the photosensitive element, and (ii) makes the separator to move the developing device away from the photosensitive element, so that the waste developer repelled back onto the photosensitive element is discharged on the intermediate transfer member; and a waste developer collector which collects the waste developer which has been discharged on the intermediate transfer member.

7. The apparatus of claim 6, wherein the cleaning bias voltage is applied to the cleaning member, in the same polarity as the charger charges the surface of the photosensitive element, and in a value whose absolute value is smaller than that of a surface potential of the photosensitive element as charged by the charger.

8. The apparatus of claim 6, wherein the exposure device forms a plurality of electrostatic latent images, wherein the developing device forms a plurality of developer images by depositing toners of respective colors on the electrostatic latent images formed by the exposure device, and wherein the transferring device transfers the developer images onto the intermediate transfer member by superposing the developer images.

9. The apparatus of claim 6, wherein the cleaning member is disposed to act on a part of the surface of the photosensitive element at which the electrostatic latent image has been formed by the exposure device but the developer image is not formed yet by the developing device.

10. The apparatus of claim 6, wherein the cleaning member is disposed to act on a part of the surface of the photosensitive element which has been charged by the charger and at which the electrostatic latent image is not formed yet by the exposure device.

11. A color image forming apparatus comprising:

a plurality of image forming units, each of which comprises:

(a) a photosensitive element;

(b) a charger which electrostatically charges a surface of the photosensitive element uniformly at a voltage of a polarity;

(c) an exposure device which exposes the surface of the photosensitive element as electrostatically charged by the charger, to a light, so as to form an electrostatic latent image;

(d) a developing device which deposits a developer of a respective color on the electrostatic latent image formed by the exposure device on the photosensitive element, to form a respective developer image;

(e) a transferring device which transfers the respective developer image on the photosensitive element onto a transfer object; and (f) a first developer removing device comprising a first cleaning member to which a cleaning bias voltage is applied to generate a cleaning bias as a value of a bias voltage applied between the cleaning member and the photosensitive element, to remove a waste developer adhering to the surface of the photosensitive element after the respective developer image is transferred onto the transfer object;

a belt circulation mechanism comprising: a belt capable of being circulated along a path including a straight line extending along a row of the transferring devices of the respective image forming units; and a belt drive device for circulating the belt;

a second developer removing device which comprises a second cleaning member brought into contact with the belt at a predetermined point in the path of circulation of the belt, so as to remove a waste developer adhering to the surface of the belt circulated; and a first cleaning member cleanup controller which operates to apply respective bias voltages to the first cleaning member, the photosensitive element, the belt, and the second cleaning member, such that a waste developer adhering to the first cleaning member is transferred to the second cleaning member via the photosensitive element and the belt, wherein the developing device is of contact development kind comprising a developing member which carries the developer of the color and contacts the photosensitive element to have the developer adhere to the photosensitive element so as to form the developer image, the apparatus further comprising a separator which moves the developing device away from the photosensitive element when the developer is transferred from the first cleaning member to the second cleaning member.

12. The apparatus according to claim 11, wherein the first cleaning member is disposed to act on a part of the surface of the photosensitive element which has been charged by the charger and at which the developer image is not formed yet by the developing device, for removing the waste developer thereon.

13. The apparatus according to claim 11, further comprising a waste developer collector which collects the waste developer which has been removed from the belt by the second cleaning member.

14. The apparatus according to claim 11, wherein the belt is provided by a carrier belt for carrying a recording medium as the transfer object.

15. The apparatus according to claim 11, wherein the belt is provided by an intermediate transfer belt which carries the developer image transferred from the photosensitive element so that the developer image is again transferred onto a recording medium.

* * * * *